US011351413B2

(12) United States Patent
van der Kroft et al.

(10) Patent No.: US 11,351,413 B2
(45) Date of Patent: Jun. 7, 2022

(54) MOVEMENT PLATFORM FOR BICYCLE TRAINER

(71) Applicant: Tacx B.V., Wassenaar (NL)

(72) Inventors: Jozef Cornelis Daniel van der Kroft, Wassenaar (NL); Martin Smits, Wassenaar (NL)

(73) Assignee: Tacx B.V., Wassenaar (NL)

( * ) Notice: Subject to any disclaimer, the term of this patent is extended or adjusted under 35 U.S.C. 154(b) by 10 days.

(21) Appl. No.: 16/947,878

(22) Filed: Aug. 21, 2020

(65) Prior Publication Data

US 2022/0054885 A1 Feb. 24, 2022

(51) Int. Cl.

| | |
|---|---|
| ***A63B 22/06*** | (2006.01) |
| ***A63B 21/005*** | (2006.01) |
| ***A63B 21/012*** | (2006.01) |
| ***A63B 69/16*** | (2006.01) |

(52) U.S. Cl.

CPC ..... *A63B 22/0605* (2013.01); *A63B 21/0058* (2013.01); *A63B 21/0125* (2013.01); *A63B 69/16* (2013.01); *A63B 2022/0641* (2013.01); *A63B 2069/165* (2013.01)

(58) Field of Classification Search

CPC ..... A63B 21/0058; A63B 21/0051; A63B 21/0125; A63B 22/0605; A63B 69/16; A63B 2022/0641; A63B 2069/165

See application file for complete search history.

(56) References Cited

U.S. PATENT DOCUMENTS

2003/0125167 A1 7/2003 Copeland
2010/0288901 A1* 11/2010 Wallach ..... A63B 22/0076 248/346.03
2011/0218080 A1* 9/2011 Papadopoulos ..... A63B 69/16 482/61

(Continued)

FOREIGN PATENT DOCUMENTS

WO 2006027649 A1 3/2006

OTHER PUBLICATIONS

Printout from https://www.bikeacces.com/127475127473kantelplaat.html, published prior to Aug. 21, 2020.

(Continued)

*Primary Examiner* — Megan Anderson

(74) *Attorney, Agent, or Firm* — Samuel M. Korte; Max M. Ali

(57) ABSTRACT

A bicycle training system and methods of using the same. The system includes a movement platform that rests on a support surface and supports a bicycle in an upright manner with respect to the support surface. The movement platform includes a support frame having a base and at least one upstanding arm that supportably engages a portion of a frame of the bicycle, a resistance assembly operatively coupled to a portion of a drivetrain of the bicycle that applies varying levels of resistance to the portion of the drivetrain, and a plurality of bushings isolating the base from the support surface. The plurality of bushings are spherical thereby permitting the movement platform to move with respect to the support surface in response to forces applied to the bicycle frame during use of the bicycle training system.

20 Claims, 9 Drawing Sheets

(56) References Cited

U.S. PATENT DOCUMENTS

| | | | | |
|---|---|---|---|---|
| 2012/0071301 | A1* | 3/2012 | Kaylor | A63B 21/00058 482/57 |
| 2021/0362000 | A1* | 11/2021 | Iverson | A63B 71/0622 |
| 2022/0001234 | A1* | 1/2022 | Pirscher | A63B 22/18 |

OTHER PUBLICATIONS

Printout from https://www.dcrainmaker.com/2018/07/cycleops-shows-off-new-indoor-trainer-moving-platform.html, published prior to Aug. 21, 2020.

Printout from https://www.dcrainmaker.com/2019/09/insiderides-new-wahoo-kickr-flex-motion-accessory-hands-on. html, published prior to Aug. 21, 2020.

Printout from https://www.rockrindoortraining.com/store/p1/ROCKR_PRO.html, published prior to Aug. 21, 2020.

* cited by examiner

MOVEMENT PLATFORM FOR BICYCLE TRAINER

BACKGROUND

Bicycle trainers are often used by cyclists for training purposes. These trainers allow cyclists to exercise and train while remaining generally stationary, typically indoors. Trainers may include an integrated bicycle (e.g., handlebars, seat, and pedals) or else be configured to attach to a cyclist's existing bicycle. For example, some trainers include rollers or sliders upon which a cyclist may place the rear wheel of their bicycle. Other trainers apply resistive or magnetic force to the bicycle's captured rear wheel. And still other trainers, known as "direct-drive" trainers, enable a cyclist to remove the rear wheel of the bicycle frame and directly attach the frame and a portion of the drivetrain of the bicycle such as the chain to the trainer.

Often bicycle trainers will provide varying levels of resistance on the bicycle's pedals during a training session to simulate a cyclist going up or down a hill, to simulate ambient conditions such as headwinds or tailwinds, or to otherwise alter the training difficulty level in response to the cyclist's input or according to a preset training program. However, because in these known trainers the bicycle frame is held generally stationary on the trainer, the cyclist's experience in responding to the varying levels of resistance is much different than would otherwise be experienced on the road. For example, when riding on the road, the bike frame will move, jump, jerk, or tilt in response to the cyclist suddenly applying increased force to the pedals when climbing a hill and thereafter seemingly recoil when the cyclist decreases force on the pedals while coasting. But because the bicycle's frame is fixed in place when using a bicycle trainer, the fixed frame provides an unnatural feel to the user as they increase or decrease their effort on the pedals.

SUMMARY

Aspects of the invention relate to a trainer that is configured to generate forward, backward, side-to-side, diagonal, tilting, and other motions based on forces applied to the bicycle's pedals or as the cyclist shifts weight or otherwise interacts with the bicycle frame during a training session. This generates more natural movement for the cyclist while training the cyclist's muscles in a similar manner as if the cyclist were riding outside on the road.

More particularly, some aspects of the invention are directed to a bicycle training system. The bicycle training system includes a movement platform configured to rest on a support surface and support a bicycle in an upright manner with respect to the support surface. The movement platform includes a support frame having a base and at least one upstanding arm configured to supportably engage a portion of a frame of the bicycle, a resistance assembly configured to operatively couple to a portion of a drivetrain of the bicycle and apply varying levels of resistance to the portion of the drivetrain, and a plurality of bushings isolating the base from the support surface. The plurality of bushings are spherical thereby permitting the movement platform to move with respect to the support surface in response to forces applied to the bicycle frame during use of the bicycle training system.

Other aspects of the invention are directed to a method of training using a bicycle training system. The method includes resting a movement platform on a support surface, such as the movement platform described above or similar.

The method further includes supporting, with the movement platform, a bicycle in an upright manner with respect to the support surface including engaging a portion of a frame of the bicycle with the at least one upstanding arm, operatively coupling a portion of a drivetrain of the bicycle to the resistance assembly, and applying various levels of resistance to the portion of the drivetrain using the resistance assembly. Finally, the method includes moving the movement platform with respect to the support surface in response to forces applied to the bicycle during use of the bicycle training system.

BRIEF DESCRIPTION OF THE DRAWINGS

Embodiments of the present invention are described in detail below with reference to the attached drawing figures, in which like numerals represent the same components, and wherein.

DETAILED DESCRIPTION

Figure 1:
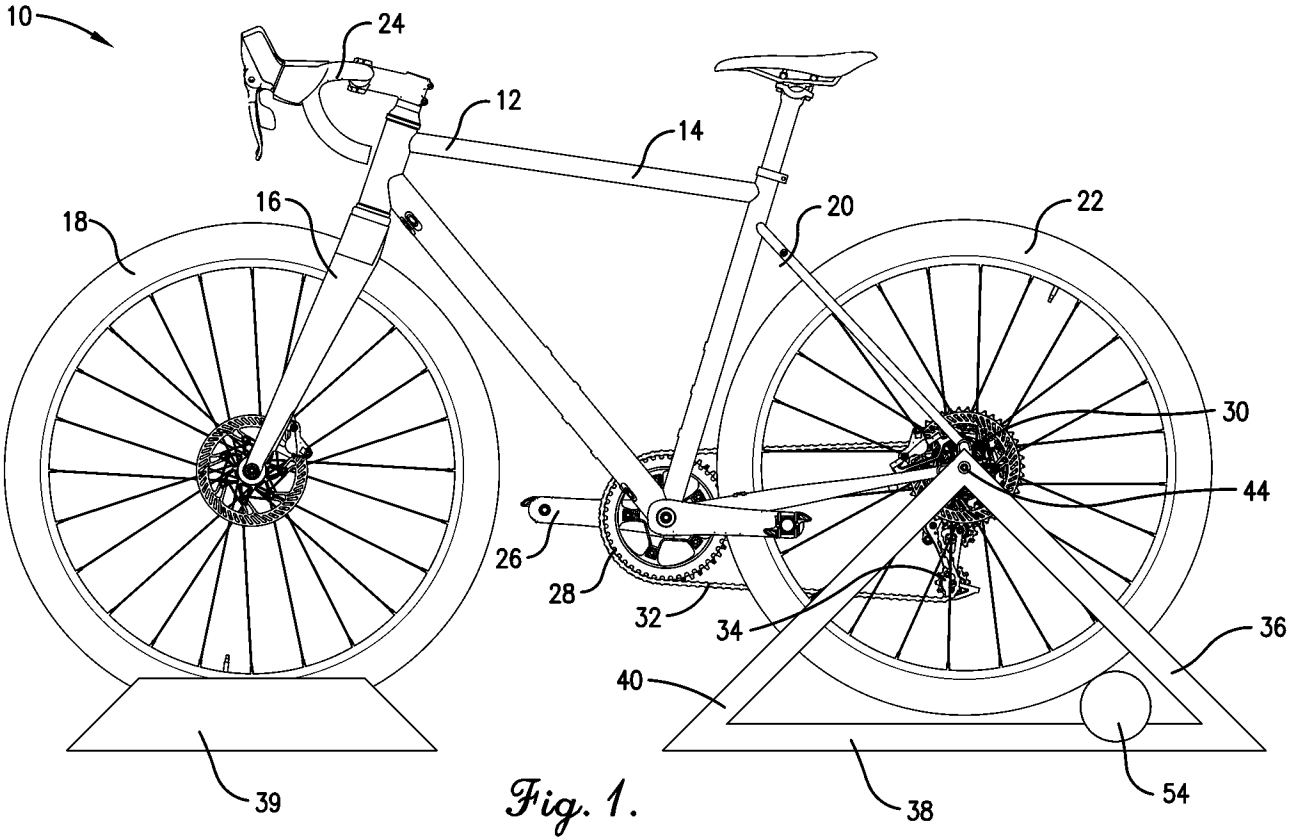
Fig. 1. PRIOR ART
FIG. 1 is a left-side elevation view of a prior-art bicycle training system.

Known bicycle training systems hold a bicycle frame and the cyclist generally stationary during a training session while providing resistance to a drivetrain of the bicycle, simulating the resistance applied to the drivetrain during an on-road ride. For example, FIG. 1 shows a conventional bicycle training system 10. Such training systems 10 typically include a conventional bicycle 12 coupled to a bicycle trainer 36. As should be appreciated, the conventional bicycle 12 generally includes an upstanding frame 14 including a front fork 16 rotatably supporting a front wheel 18 and rear stays 20 rotatably supporting a rear wheel 22. The bicycle 12 also includes handlebars 24 operatively coupled to the front fork 16 that are used to steer the bicycle during use. The handlebars 24 include various controls such as brake levers and, in some embodiments, gear shift levers which may be integral to the brake levers or else a separate components therefrom. In other embodiments, the gear shift levers may be mounted elsewhere on the frame 14 such as a downtube, or else may be omitted altogether for single-speed bicycles. When equipped, the brake levers and gear shift levers are operatively connected to brakes and derailleurs, respectively, of the bicycle 12 via a series of cables allowing the user to activate the brakes and shift between gears during a ride.

The bicycle 12 further includes a series of chainrings 28 operatively coupled to a pedal set 26. A chain 32 stretches from one of the chainrings 28 to a rear cassette 30 coupled to the hub of the rear wheel 22, and more particularly to a sprocket of the cassette 30. In this regard, as a cyclist turns the pedal set 26, the chainrings 28 also rotate, which in turns rotates the rear wheel 22 via the chain 32 transmitting the motion to the rear cassette 30, propelling the bicycle 12 forward. The cyclist can shift between chainrings 28 and sprockets on the rear cassette 30 via a front derailleur and rear derailleur 34, respectively, thereby upshifting and downshifting as desired in response to encountering a hill, headwind or tailwind, or other condition.

The bicycle trainer 36 supports the frame 14 in the upright and stationary fashion while allowing the user to crank the pedal set 26 and thus turn the rear wheel 22. More particularly, the bicycle trainer 36 includes a support frame including a base 38 and an upstanding frame member 40. The base 38 rests on a support surface and the upstanding frame member 40 engages a portion of the bicycle frame 14 such as the rear stays 20 of the bicycle frame 14 or a rear axle 44 extending through a hub of the rear wheel 22 in such a manner that the frame 14 is secured in the upright position while the rear wheel 26 is elevated from the support surface. The training system may also include a front wheel clamp 39 that holds the front wheel 18 upright and steady during use of the system.

The bicycle trainer 36 may include a roller 54 or similar mechanism that engages the rear wheel 22 and provides resistance thereto, simulating an on-road riding experience. In some embodiments, the roller 54 may be adjustable to provide varying levels of resistance and thus simulate certain ambient conditions during a virtual ride such as hills, headwinds or tailwinds, varying terrain, or other rear-world riding conditions causing a cyclist to downshift or upshift as they would do on the road. Thus, a cyclist using the bicycle training system 10 can train on their bike indoors and is provided a somewhat realistic riding experience notwithstanding that the bicycle 12 remains stationary during use.

However, because the frame 14 and thus the cyclist using the training system 10 is held stationary by the trainer 36 and/or the front wheel dock 39 during use, conventional training systems 10 fail to provide the cyclist dynamic feedback or an on-the-road feel as the cyclist shifts gears, increases or decreases force on the pedals, or shifts their weight. Moreover, these conventional training systems 10 may fail to train the proper muscle groups, because the static frame does not require the same cyclist movements and adjustments necessary during on-road riding.

In contrast, aspects of the present invention include a dynamic system that moves and reacts to a cyclist's inputs, thus providing a more accurate on-road feel to the cyclist. The movement of the system simulates the natural movement of a bicycle on the road and ensures that the cyclist's correct muscles are trained. More particularly, at a high level aspects of the invention include a movement platform operatively coupled to a bicycle trainer to provide movement in all directions (left, right, front, back, diagonal, up, down, etc.), thereby simulating an on-road experience while training a cyclist's muscles in a similar fashion as outdoor riding.

Figure 2:
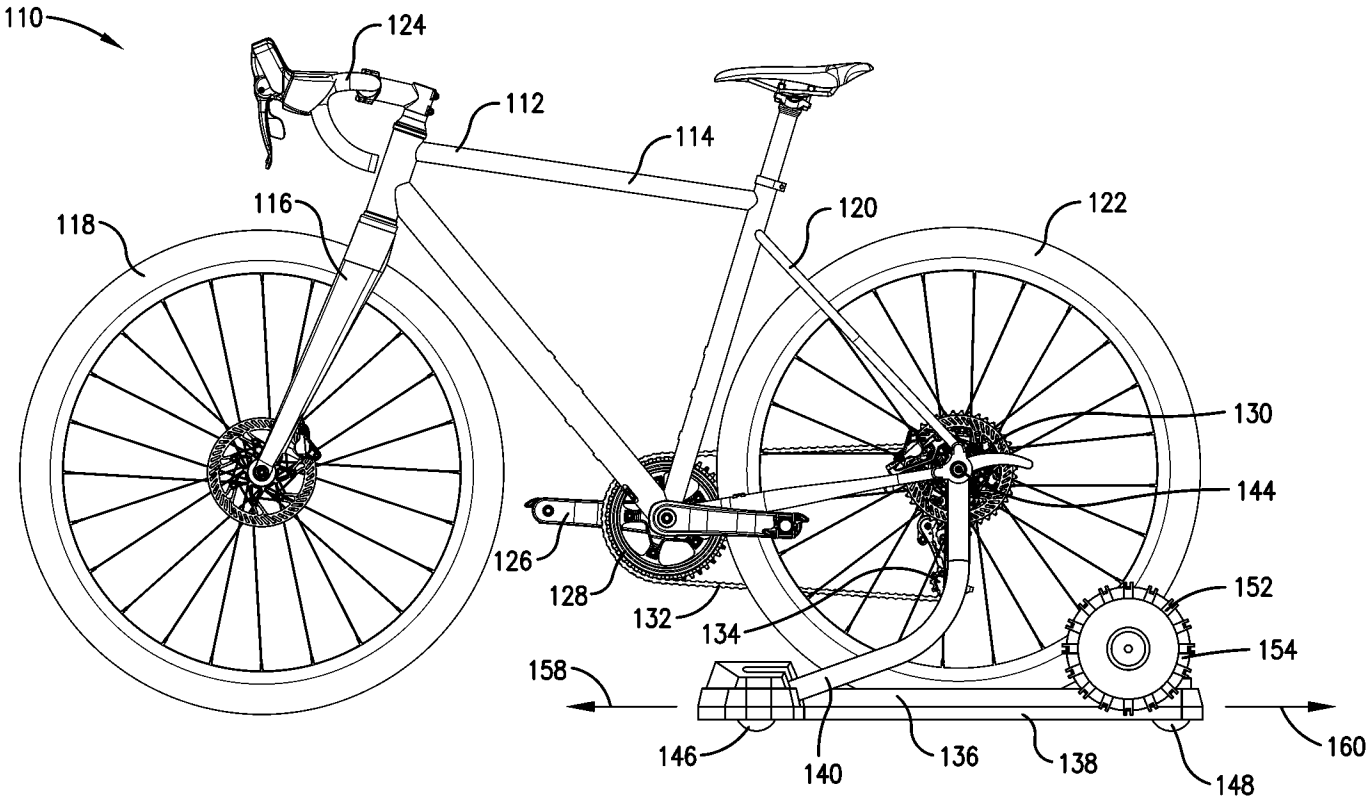
FIG. 2 is a left-side elevation view of an improved bicycle training system according to an embodiment of the invention.

This will be more readily apparent with reference to FIGS. 2-13. First, FIGS. 1 and 2 show a first embodiment of an improved bicycle training system 110 according to aspects of the invention. At a high level the bicycle training system 110 includes a bicycle 112 operatively coupled to a movement platform 136, which provides varying levels of resistance to the bicycle 112's drivetrain during a training session while dynamically responding to the user's inputs, weight shifts, and other motions.

The bicycle 112 generally includes an upright frame 114 supporting various components such as a front fork 116 rotatably supporting a front wheel 118, rear stays 120 rotatably supporting a rear wheel 122, handlebars 124 operatively coupled to the front fork 116, a pedal set 126 coupled to one or more chainrings 128, and a rear cassette 130 driven by the pedal set 126 and chainrings 128 via a chain 132. The rear cassette 130 includes multiple sprockets which selectively receive the chain 132 as a user shifts gears causing a rear derailleur 134 to shift the chain 132 among the sprockets. In this regard, the frame 114, front fork 116, front wheel 118, rear stays 120, rear wheel 122, handlebars 124, pedal set 126, chainrings 128, rear cassette 130, chain 132, and rear derailleur 134 of bicycle 112 are similar in construction and function to the frame 14, front fork 16, front wheel 18, rear stays 20, rear wheel 22, handlebars 24, pedal set 26, chainrings 28, rear cassette 30, chain 32, and rear derailleur 34, respectively, of bicycle 12, and thus each component will not be discussed again in detail.

The bicycle training system 110 includes the movement platform 136 operatively coupled to a rear portion of the bicycle frame 114 and more particularly to the rear stays 120 and/or the rear wheel 122 of the bicycle 112. The movement platform 136 generally includes a support frame including a base 138 and a pair of upstanding arms 140, 142 extending upwards from the base 138 and flanking the rear wheel 122. More particularly, the first upstanding arm 140 is provided on a left side of the rear wheel 122 and supports a left side of the frame 114, while the second upstanding arm 142 is provided on a right side of the rear wheel 122 and supports the right side of the frame 114. Each arm 140, 142 is configured to couple to and thus support a rear portion of the bicycle frame 114 either directly or via a rear axle 144 or similar component.

For example, in the depicted embodiment the arms 140, 142 support the frame 114 via the rear axle 144 extending through a hub of the rear wheel 122. In some embodiments, the rear axle 144 may be an integral component of the bicycle 112 and may be, for example, a skewer-type axle or the like that holds the rear wheel 122 to the frame 114. In other embodiments, the rear axle 144 may be an integral component of the movement platform 136 itself. In such embodiments, the rear axle used to couple the rear wheel 122 to the frame 114 may be removed and replaced with the rear axle 144 extending through the upright arms 140, 142 when the bicycle 112 is used as a portion of the bicycle training system 110. In other embodiments, the arms 140, 142 may operatively couple near or to the distal ends the skewer-type axle used to hold the rear wheel 112 to the bicycle frame 114. In still other embodiments, the arms 140, 142 may not couple to the rear axle 144 at all but instead may couple to a different portion of the bicycle frame 114 such as the rear stays 120, the rear dropouts thereof, or the like.

In any event, the upstanding arms 140, 144 support the bicycle frame 114 in an upright manner in such a way that that rear wheel 122 is permitted to rotate in response to a user's input on the pedal set 126. In that regard, when the frame 114 is supported by the movement platform 136 (and more particularly the arms 140, 144 thereof), the rear wheel 122 will be suspended from a support surface on which the movement platform 136 rests such that the rear wheel 122 can rotate without the bicycle 112 moving forward. Instead, the movement platform 136 supports the rear wheel 122 in such a way that it engages and interacts with a resistance assembly 152. The resistance assembly 152 generally includes a resistance mechanism 154 operatively coupled to a roller 156. The roller 156 engages and interacts with the rear wheel 122 (FIG. 3) such that when a cyclist pedals the pedal set 126 spinning the rear wheel 122, the roller 156 engaged therewith spins as well.

The resistance mechanism 154, in turn, is configured to apply a varying amount of resistance to the roller 156 and thus the rear wheel 122 and ultimately the pedal set 126. The varying levels of resistance requires varying amounts of effort on behalf of the cyclist thus simulating hills, winds, and other ambient conditions attendant with an on-road experience. In the depicted embodiment, the resistance mechanism 154 is an electric rotor and stator assembly. The rotor and stator assembly may include electromagnets or the like that can be used to alter the rotational resistance applied to the roller 156 and thus the pedal set 126 of the bicycle frame 114. For example, to simulate a hill or to otherwise increase resistance during a training program, the resistance assembly 152 may increase the rotational resistance to the rotor (and thus the roller 156 and thus the rear wheel 122) by increasing electricity flow to the stator electromagnets.

The resistance supplied by the resistance assembly 152 may be controlled via a user control mounted to the handlebars 124 or other portion of the bicycle frame 114, or in some embodiments may be controlled automatically by an controller that may be integral to the training system 110 or else may be in communication with the training system 110 such as by RF, bluetooth, wifi, wired connection, or other communication channel. In such embodiments, the controller may follow a preset training program selected by the cyclist. For example, when using the bicycle training system 110 the cyclist may select a certain route, road, path, race, etc. that the cyclist wishes to simulate using the training system 110, and thus the resistance assembly 152 in turn may increase or decrease resistance on the rear wheel 122 in response to the cyclist encountering hills and similar on the virtual ride.

Although the depicted bicycle training system 110 incorporates the roller 156 that operatively engages the rear wheel 122 of the bicycle 112, in other embodiments the training system could incorporate a direct-drive type bicycle trainer without departing from the scope of the invention. In such embodiments, the user would first remove the rear wheel and associated cassette from the bicycle frame completely, and thereafter connect a portion of the bicycle's drivetrain (such as the chain and associated rear derailleur) to an integral cassette provided on the bicycle trainer. This will become more apparent below in connection with the discussion of FIGS. 10 and 11.

Figure 3:
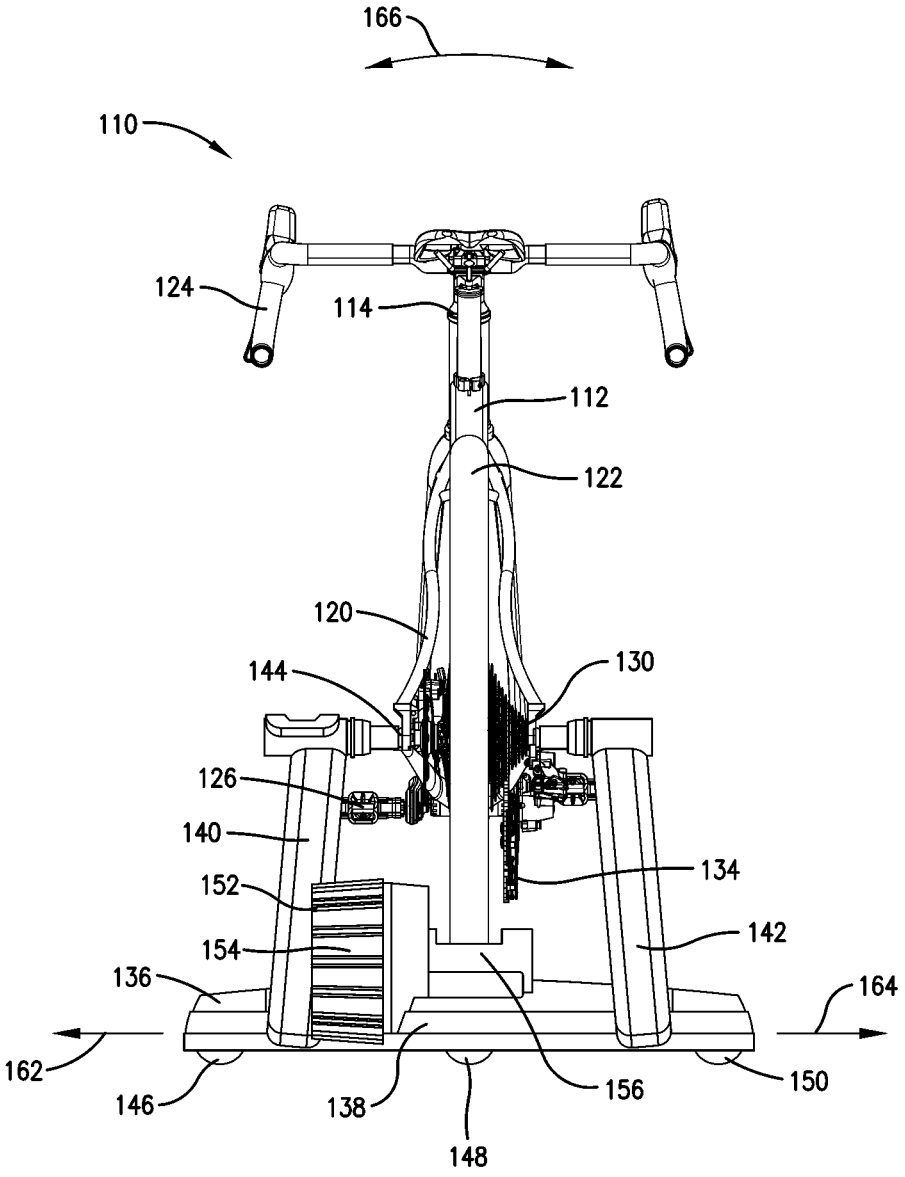
FIG. 3 is a rear elevation view of the bicycle training system shown in FIG. 2.

Moreover, although the resistance mechanism 154 in FIGS. 2 and 3 is shown as an electric rotor and stator assembly, other suitable resistance mechanisms may be implemented without departing from the scope of the invention. For example, a mechanical braking system could be employed such as a disc or drum brake system. Thus, the brake pads or brake shoes will increase or decrease pressure on the rotating disc or drum to increase or decrease, respectively, resistance to the rear wheel 122 of the bicycle 112. In other embodiments, other types of resistance mechanisms may be employed such as, for example, a mechanical clutch system or the like without departing from the scope of the invention.

The movement platform 136 includes a plurality of bushings 146, 148, 150 isolating the base 138 of the movement platform 136 from the support surface on which the platform 136 rests. Put another way, unlike the prior-art training system 10 discussed above in which the base 38 rests directly on the support surface thus holding the trainer 36 stationary during use, in this embodiment the base 138 (including platform 136) is elevated and isolated from the support surface due to the presence of the bushings 146, 148, 150 between the base 138 and the support surface. As will be discussed in more detail below, these bushings 146, 148, 150 allow the movement platform 136 to shift and pivot during use, providing a user a dynamic and real-world riding experience.

The depicted embodiment includes three bushings 146, 148, 150 located at the vertices of an imaginary isosceles triangle, but in other embodiments there may be more or less bushings spaced and arranged in an alternative configuration without departing from the scope of the invention. Two bushings 146, 150 are provided at a front portion of the movement platform 136, generally below the pedal set 126 and flanking the rear wheel 122. The first bushing 146 is coupled to a wing of the base 138 that extends outward from the bicycle 112 on the left side of the frame 114 while the third bushing 150 is coupled to an opposing wing of the base 138 that extends outward from the bicycle 112 on the right side of the frame 114 (FIG. 3). The second bushing 148 is provided at the rear portion of the base 138 generally below the rearmost portion of the rear wheel 122 and at a center of the base 138 such that the second bushing 148 is vertically aligned with the rear wheel 122 (FIG. 3).

In configurations, the bushings 146, 148, 150 are spherical and configured to translate via rolling movement such that the movement platform 136 moves in response to a user shifting gears, shifting weight, standing up on the pedal set 126, or otherwise applying forces to the bicycle 112. This may be more readily understood with reference to FIGS. 4 and 5, which shows one of the bushings 146, 148, 150 described above. In some configurations, bushing 146, 148, 150 are elastically deformable to assist in generation of the rolling movement. Because in this embodiment the bushings 146, 148, 150 are generally alike in shape, construction, and function, only one bushing 146, 148, 150 is shown and described in FIGS. 4 and 5 for ease of discussion. However, aspects of the invention are not limited to training systems employing identical bushings, and in other embodiments each of the bushings 146, 148, 150 could differ in shape and construction from the other bushings without departing from the scope of the invention. For example, one of the three bushings 146, 148, 150 could have a generally spherical construction as shown in described in FIGS. 4 and 5, while the other two bushings could have a different shape such as the shape of one of the bushings that will be discussed below in connection with FIGS. 6-9.

The bushing 146, 148, 150 generally includes a main body 168 and a post 170 or other attachment portion. The main body 168 is configured to support the movement platform 136 about a support surface and interact therewith as the movement platform 136 rocks and translates. In the depicted embodiment, the main body 168 is substantially spherical in shape—that is, the outer surface thereof generally follows the contour of a sphere except for an uppermost portion of the main body 168 that couples to the post 170—but in other embodiments the main body 168 can take any desired shape without departing from the scope of the invention, which will become more apparent in connection with the discussion of FIGS. 6-9.

At a top of the main body 168 is the post 170, which in the non-limiting example shown in the figures is generally circular in cross-section and thus is generally cylindrical in shape. Again, however, in other embodiments the post 170 can take any number of cross-sections and shapes without departing from the scope of the invention, as will become more apparent below. The post 170 is received within a correspondingly shaped and sized seat or the like (not shown) provided on an underneath side of the base 138 of the movement platform 136 thus securing the bushing 146, 148, 150 to the base 138. The post 170 may be secured within the base 138 in any known matter including via an interference fit with the corresponding seat, via a fastener such as a bolt or screw extending through the base 138 and into the post 170, via a clamp pressing the post 170 against the corresponding seat, via adhesive applied to the post 170 or the seat, or via any other desired fastening mechanism.

The bushing 146, 148, 150 is configured to translate via rolling movement to permit the movement platform 136 to translate horizontally and vertically and to pivot in the left and right direction during use of the bicycle training system 110. That is, bushing 146, 148, 150 roll, shift, rotate, pivot, or otherwise translate to provide rolling movement, which in turn permits movement of the movement platform 136. In some examples, the bushing 146, 148, 150 is constructed of a highly resilient, deformable material such as rubber or another similarly constituted polymer to deform and deflect in order to assist in generation of the rolling movement. Due to its high resiliency—that it, ability to absorb energy when deformed elastically and to release the energy upon being unloaded—the bushing 146, 148, 150 deforms elastically under load (in response to forces applied by the user during a training session), and thereafter returns to its equilibrium position when unloaded. However, in some configurations, bushing 146, 168, 150 may be comprised of rigid or inelastic materials that enable the movement platform 136 to translate only through rolling movement.

Figure 4:
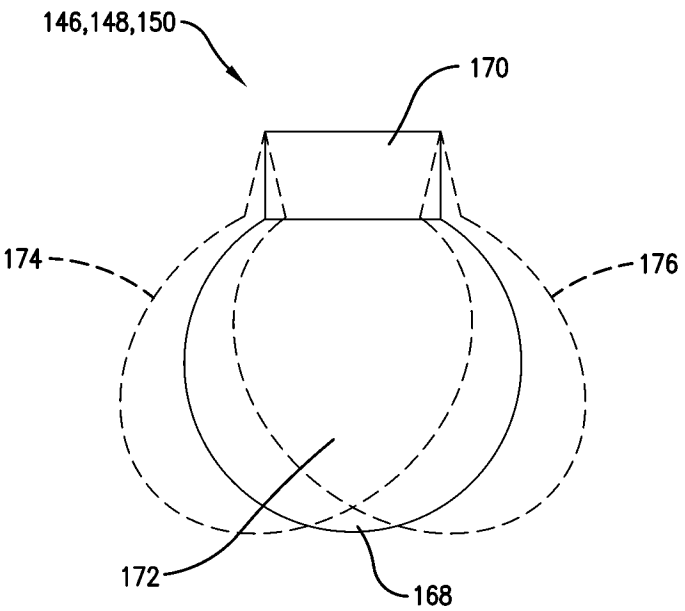
FIG. 4 is a close-up, elevation view of a bushing of the bicycle training system shown in FIGS. 2-3.

For example, FIG. 4 shows three positions of the bushing 146, 148, 150: an equilibrium position 172, a first shifted position 174 (schematically shown in phantom lines), and a second shifted position 176 (also schematically shown in phantom lines). As a user shifts their weight, changes gears, or otherwise interacts with the bicycle training system 110, the bushing 146, 148, 150 elastically deforms and thus translates between the three positions 172, 174, 176 shown. It should be appreciated that the three distinct positions 172, 174, 176 are shown for discussion purposes only, and that in use there will be infinite positions in which the bushing 146, 148, 150 translate as it is loaded and unloaded by the user. Moreover, although the bushing 46, 48, 50 is shown translating between three positions 172, 174, 176 in the left-to-right direction as viewed in FIG. 4, it should be appreciated that the deformation is not so limited. That, is the bushing 146, 148, 150—particularly when constructed as having a substantially spherical outer surface as shown in FIGS. 4 and 5—has 360 degrees of freedom and thus can translate in an infinite number of directions in the horizontal plane.

Figure 5:
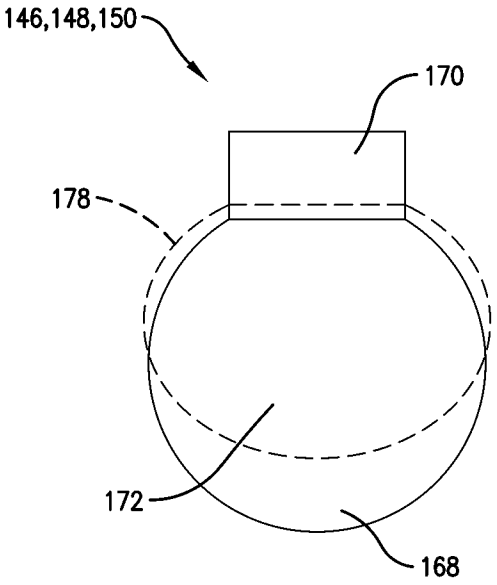
FIG. 5 is another close-up, elevation view of the bushing shown in FIG. 4.

Moreover, and as schematically shown in FIG. 5, the bushing 146, 148, 150 is further configured to compress and decompress as it is loaded and unloaded during use of the bicycle training system 110. More particularly, FIG. 5 schematically shows, in phantom lines, a compressed position 178 of the bushing 146, 148, 150. As the user increases force in the vertical direction on the bushing 146, 148, 150, the bushing 146, 148, 150 can thus elastically deform from the equilibrium position 172 to one of an infinite number of compressed positions such as the compressed position 178, shown as one non-limiting example.

The horizontal (FIG. 4) and vertical (FIG. 5) elastic deformation and movement of the bushings 146, 148, 150 provides a dynamic response to a user of the bicycle training system 110 because the movement platform 136 moves and reacts to the user's various inputs, weight shifts, and other movements on the bicycle 112 during a training session via the deformation of the bushings 146, 148, 150. For example, in response to the increased resistance applied to the rear wheel 122 and thus the pedal set 126 by the resistance assembly 152, the cyclist may in turn increase the force applied to the pedal set 126, stand up on the pedal set 126, shift their weight, and/or shift the chain 132 among the chainrings 128 or sprockets on the rear cassette 130. In response, the external and varied forces applied by the cyclist causes one or more of the bushings 146, 148, 150 to elastically deform and/or translate, shifting and/or pivoting the movement platform 136.

For example, if the user exerts a force on the bicycle frame 114 in the generally forward direction (to the left as viewed in FIG. 2), each bushing 146, 148, 150 may generally deform from the equilibrium position 172 to the second shifted position 176, in turn causing the movement platform 136 to rock or translate forward as schematically depicted by arrow 158. Once the cyclist let up in response to a subsequent decrease in resistance by the resistance assembly 152 or other change, the bushings 146, 148, 150 may return towards the equilibrium position 172, and thus the movement platform 136 will translate rearward (arrow 160 in FIG. 2). Conversely, if the user exerts a force on the bicycle frame 114 in the generally rearward direction (to the right as viewed in FIG. 2), each bushing 146, 148, 150 may generally deform from the equilibrium position 172 to the first shifted position 174, in turn causing the movement platform 136 to rock or translate backward as schematically depicted by arrow 160, before returning towards the equilibrium position 172 as each bushing 146, 148, 150 is subsequently unloaded.

In a similar manner, if the user exerts forces on the bicycle frame 114 in the side-to-side directions (left-to-right as viewed in FIG. 3), the bushings 146, 148, 150 elastically deform and permit the movement platform 136 to move left and right as schematically depicted by arrows 162 and 164, respectively, before ultimately returning the equilibrium position 172 as the bushings 146, 148, 150 are subsequently unloaded. Or, if a user shifts their weight to the left and right, any bushings to the left and right, respectively, of the bicycle 112's center line (in the depicted embodiment, first bushing 146 and third bushing 150, respectively) may compress from the equilibrium position 172 to the compressed position 178, and thereafter decompress from the compressed position 178 to the equilibrium position 172. This causes the movement platform 136 to pivot about its centerline as schematically depicted by arrow 166 in FIG. 3. In this regard, the movement of the bicycle frame 114 provided by the movement platform 136 replicates the feel of outdoor riding while training like muscle groups as would be used during an on-road ride.

In the depicted embodiment of the bicycle training system 110, the front wheel 118 rests on the support surface. Thus, during movements of the movement platform 136 as described, particularly in the forward and rearward directions as schematically depicted by arrows 158 and 160, the front wheel 118 freely rolls about the support surface. However, in other embodiments, the front wheel may be clamped or otherwise secured in a translating sled or the like (not shown, but similar to the front wheel clamp 39 although with rollers, bushings, or the like isolating the base of the clamp from the support surface) without departing from the scope of the invention.

The substantially spherical bushings 146, 148, 150 described above may provide a relatively smooth recoil of the movement platform 136 while allowing for movement of the movement platform 136 is substantially 360 degrees due to the spherical outer surface of the main body 168, which interacts with the support surface when the bushing 146, 148, 150 is loaded and thus elastically deformed. However, the invention is not limited to substantially spherical bushings and in other embodiments the bushings make take alternative shapes and configurations providing for a different load profile and thus recoil.

Figure 7:
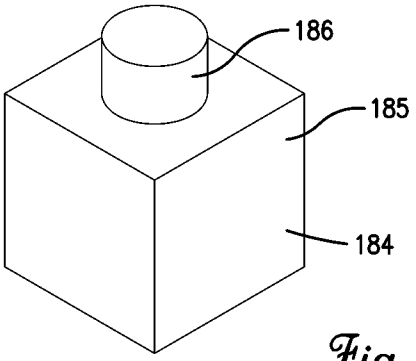
FIG. 7 is a perspective view of another alternative design for a bushing that can be implemented in embodiments of the invention such as the bicycle training system shown in FIGS. 2-3.
Figure 9:
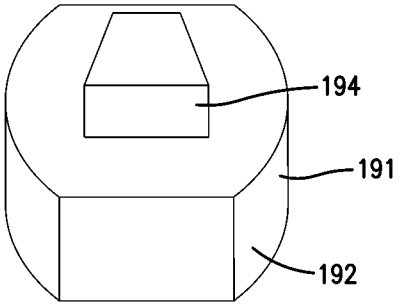
FIG. 9 is a perspective view of another alternative design for a bushing that can be implemented in embodiments of the invention such as the bicycle training system shown in FIGS. 2-3.
Figure 6:
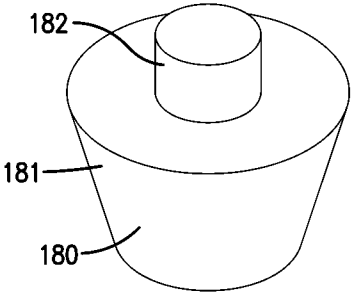
FIG. 6 is a perspective view of an alternative design for a bushing that can be implemented in embodiments of the invention such as the bicycle training system shown in FIGS. 2-3.
Figure 8:
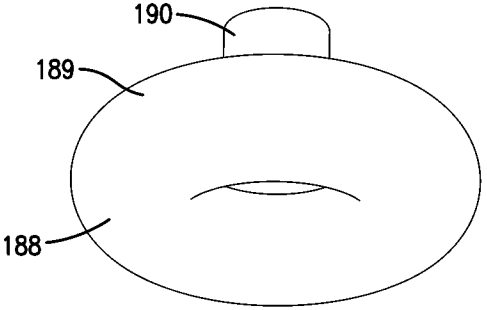
FIG. 8 is a perspective view of another alternative design for a bushing that can be implemented in embodiments of the invention such as the bicycle training system shown in FIGS. 2-3.

This may be more readily understood with reference to FIGS. 6-9, which show four alternative bushings 180, 184, 188, 192 that may be employed on certain embodiments without departing from the scope of the invention. More particularly, FIG. 6 shows a bushing 180 having a substantially frustoconical main body 181 with a cylindrical post 182. FIG. 7 shows a bushing 184 having a cuboidal main body 184 with a cylindrical post 186. FIG. 8 shows a bushing 188 having a donut-shaped main body 189 and a cylindrical post 190. And FIG. 9 shows a bushing 192 having an irregularly shaped main body 191 and a rectangular prism post 194. Again, the shape of the posts 182, 186, 190, and 194 of each bushing 146, 148, 150, 180, 184, 188, 192 are shown for illustrative purposes only and can varied without departing from the scope of the invention. Thus, any of bushings 146, 148, 150, 180, 184, or 188 could employ a rectangular prism post (such as post 194) or any other suitably shaped post while bushing 192 could employ a cylindrical post (such as post 170, 182, 186, or 190) or any other suitably shaped post without departing from the scope of the disclosure.

Each bushing may provide a different load and/or recoil profile and thus a different dynamic experience to a cyclist using a training system such as the bicycle training system 110 discussed above. For example, due to its flat side facing the support surface, the frustoconical main body 181 may be relatively sturdy, and thus not easily deformed when exposed to small external forces, but due its curved frustoconical outer surface may elastically deform in a like manner as the bushing 146, 148, 150 when exposed to large external forces and thus is rocked off its flat surface. This may provide a user with a relatively stationary platform 136 for much of the ride yet permit movement in response to large changes in the user's position or otherwise.

The cuboidal main body 185 may similarly exhibit a relatively stationary ride when exposed to relatively minor forces. And when exposed to forces great enough to rock the bushing 184 off its downward facing face, the geometry of the cuboidal main body 185 may server to restrict horizontal movement of the platform 136 in one of four directions corresponding to the four outwardly facing faces of the cube.

The donut-shaped main body 189 may conversely exhibit great elastic deformation in response to relatively minor forces, yet very little deformation (and thus movement) beyond the initial loading. And finally, the irregularly shaped main body 191—which is shown as having a stadium shaped cross-section, but which may have any irregular cross-section tailored to a specific application—may be configured to provide different load and deformation profiles in different directions. For example, if a curved surface thereof is aligned in the front-to-back direction but not the right-to-left, the movement platform 136 may be more prone to translate in the former than in the latter.

In this regard, differently shaped and configured bushings can be employed to customize the movement and load profiles of the movement platform 136 to the user's specific training needs. In some embodiments, the bushings may be interchangeable so that a user can customize their experience but switching out the bushings prior to a training session. Thus, a user that may initially use spherical bushings can thereafter switch one or more bushings with a different shaped bushing to achieve a more customized dynamic response during a training session.

Although the above embodiments were described in connection with a roller-type training system that captures the rear wheel 122 of the bicycle 112, the invention is not so limited. For example, aspects of the invention could be employed with a direct-drive type bicycle training system without departing from the scope of the invention. This will be more readily understood with reference to FIGS. 10 and 11.

Figure 10:
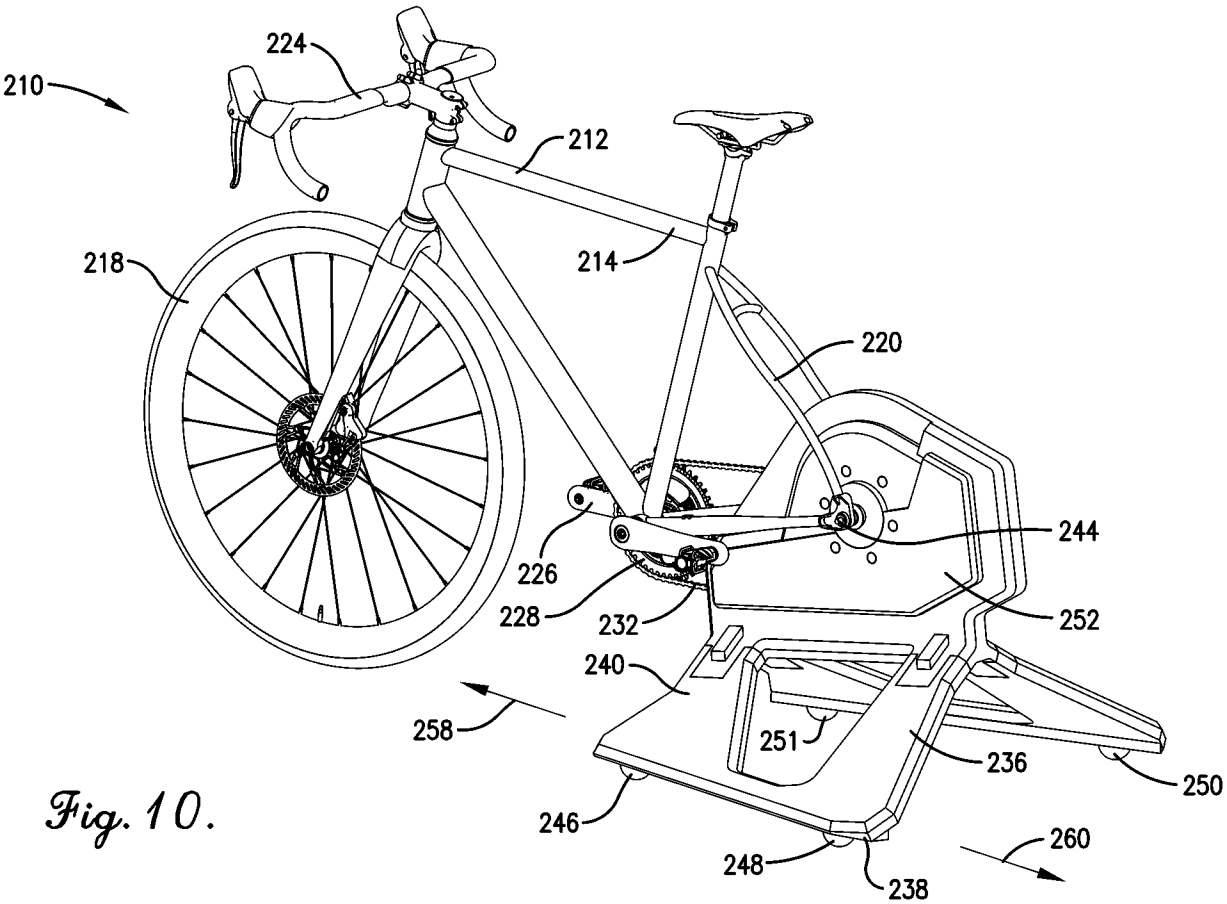
FIG. 10 is a perspective view of an improved bicycle training system according to another embodiment of the invention.
Figure 11:
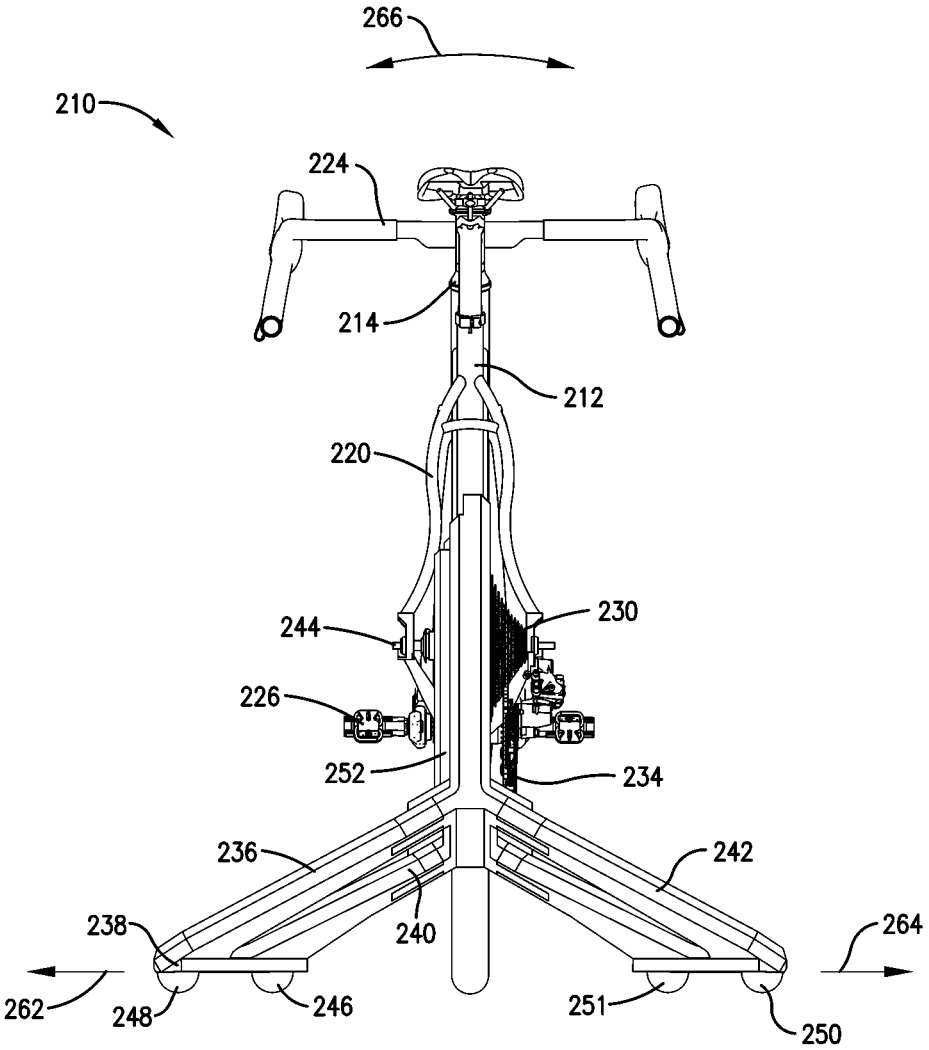
FIG. 11 is a rear elevation view of the bicycle training system shown in FIG. 10.

More particularly, FIGS. 10 and 11 show a second embodiment of a bicycle training system 210 according to aspects of the invention. In this direct-drive embodiment, the user still uses a conventional bicycle 212 coupled to a movement platform 236, but now the user first removes a rear wheel of the bicycle 212 prior to use of the system 210. The user will thereafter connect a portion of the bicycle 212's drivetrain directly to a cassette 230 integral to the movement platform 236, after which the user can shift between sprockets on the cassette 230 using the rear derailleur 234 still attached to the frame 214.

Thus, in this embodiment the bicycle training system 210 only includes a subset of the bicycle 212 components discussed above, including the frame 214, front fork 216, front wheel 218, rear stays 220, handlebars 224, pedal set 226, chainrings 228, chain 232, and rear derailleur 234, which are similar in construction and function to the frame 114, front fork 116, front wheel 118, rear stays 120, handlebars 124, pedal set 126, chainrings 128, chain 132, and rear derailleur 134, respectively, of bicycle 112, and thus will not be discussed again in detail. Notably absent are the rear wheel and associated rear cassette of the bicycle 212, which are removed by the user prior to use of the trainer. Instead, the user supports the frame 214 via a rear axle 244 or other component provided on the movement platform 236 and connects the chain 232 to a cassette 230 integral to the movement platform 236.

The movement platform 236 generally includes a support frame including a base 238 and a pair of upstanding arms 240, 242 supporting a resistance assembly 252. Similar to the resistance assembly 152 discussed above, the resistance assembly 252 may include an integral electric rotor and stator assembly, mechanical brake, clutch, or other resistance mechanism configured to apply a varying amount of resistance to the cassette 230 and thus the pedal set 226 operatively connected to the cassette 230 via the chain 232 and chainrings 228. Moreover, the base includes a plurality of bushings—in this embodiment, four bushings 246, 248, 250, and 251—isolating the movement platform 236 from the support surface on which the movement platform 236 rests. As should be appreciated, the bushings 246, 248, 250, and 251 can take any of the forms described above, or any other suitable shape for that matter, without departing from the scope of the invention.

In a like fashion as discussed above, the bushings 246, 248, 250, and 251 permit movement of the movement platform 236 during a training session, providing a dynamic, on-road feel. More particularly, the bushings 246, 248, 250, and 251 may permit the movement platform to horizontally translate back and forth (arrows 258 and 260 in FIG. 10) and side to side (arrows 262 and 264 in FIG. 11), as well as pivot from side to side (arrow 266 in FIG. 11).

Figure 12:
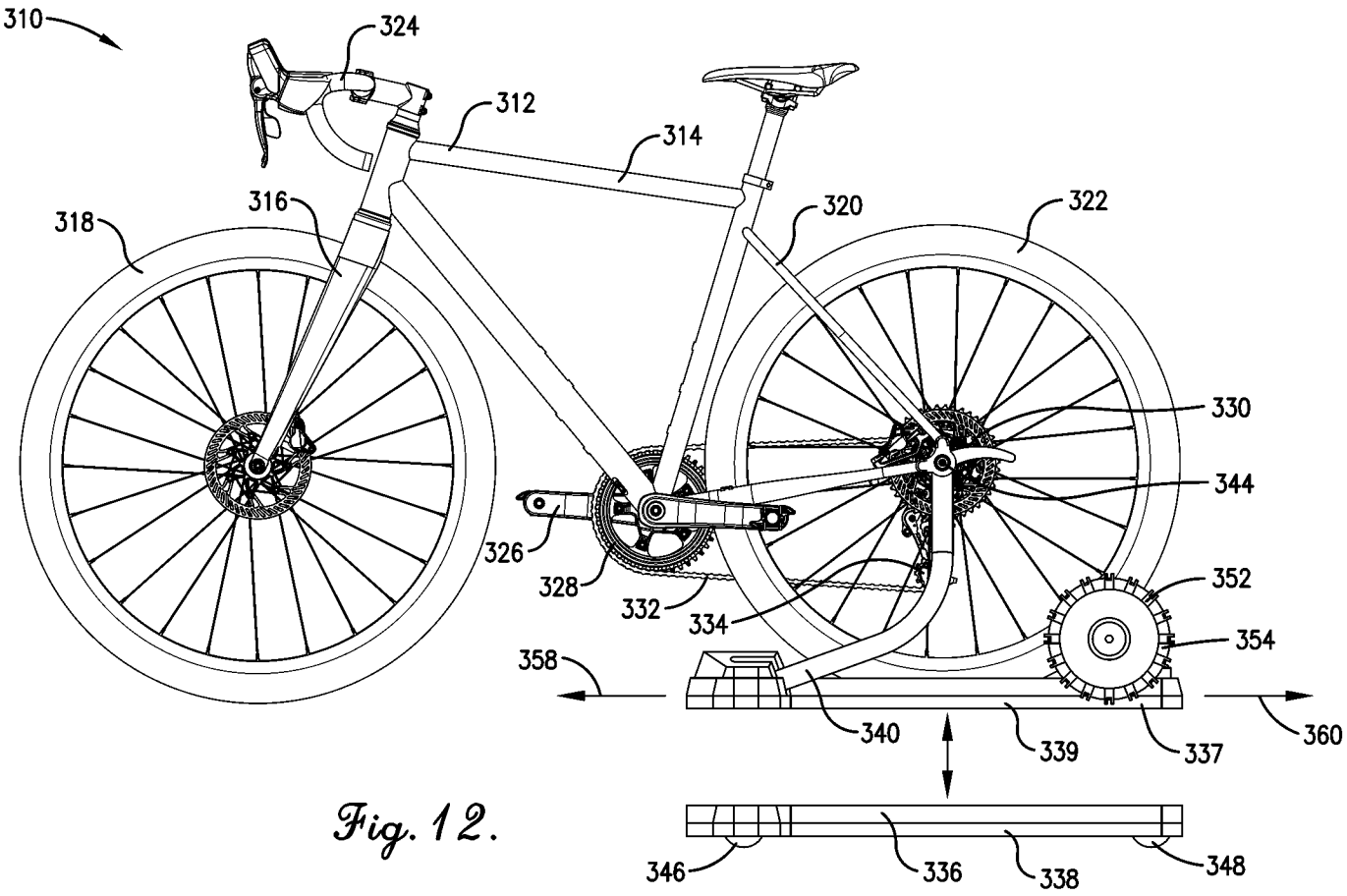
FIG. 12 is a left-side elevation view of an improved bicycle training system according to another embodiment of the invention.
Figure 13:
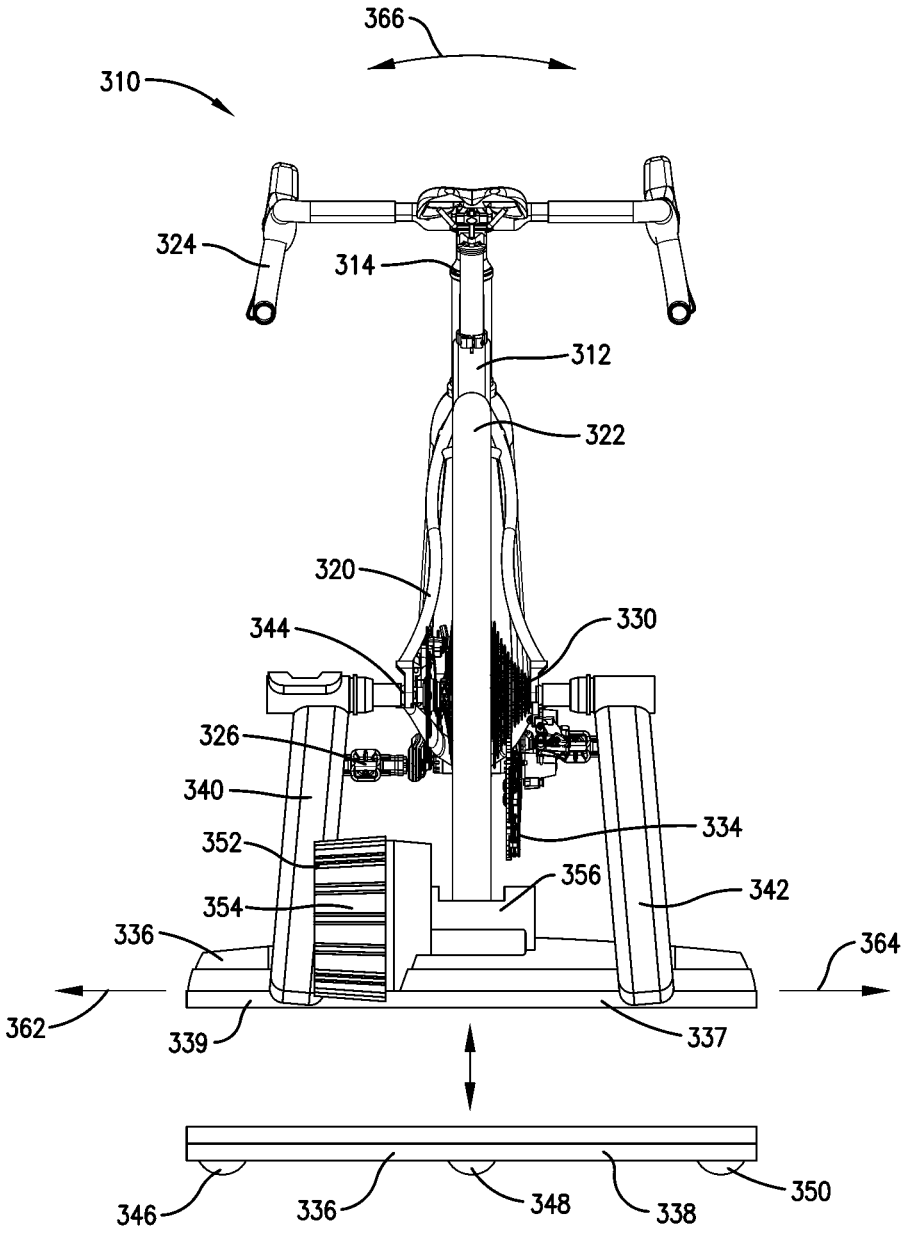
FIG. 13 is a rear elevation view of the bicycle training system shown in FIG. 12.

Finally, FIGS. 12 and 13 show a third embodiment of a bicycle training system 310 according to aspects of the invention. The training system 310 shown in FIGS. 12 and 13 is a captured rear wheel, roller-type training system similar to the system 110 shown and described in connection with FIGS. 2 and 3, but again the aspects described herein could be employed in a direct-drive type system similar to the system 210 shown and described in connection with FIGS. 10 and 11 without departing from the scope of the invention. Moreover, the system 310 includes many components that are like in configuration and function to the similarly named and numbered components of the training system 110—including a bicycle 312, the frame 314, front fork 316, front wheel 318, rear stays 320, rear wheel 322, handlebars 324, pedal set 326, chainrings 328, rear cassette 330, chain 332, rear derailleur 334, upstanding arms 340, 342, rear axle 344, bushings 346, 348, 350, resistance assembly 352, resistance mechanism 354, and roller 356—which thus will not be discussed again in detail.

In this embodiment, however, a bicycle trainer 337—which includes the support frame including a base 339 and upstanding arms 340, 342 and which supports the resistance assembly 352—is a separate and distinct component from the movement platform 346—which houses the bushings 346, 348, 350 provided in respective seats on the base 338 thereof. In this regard, the training system 310 can be used in either a static or dynamic mode. In a static mode, the user rests the base 339 of the trainer 337 directly on a support surface, without use of bushings 346, 348, 350, and thus like the prior-art system 10 described in connection with FIG. 1, the trainer 337 and thus the bicycle frame 314 supported therein will not move in response to a user shifting their weight, changing gears, etc. However, if the user wishes to achieve the dynamic, on-road type experience described herein, the user can place the trainer 337 on the appropriately sized and shaped movement platform 336, which will in turn isolate the trainer 337 from the support surface via the bushings 346, 348, 350 in a like manner as described in detail. In this mode, the user will receive dynamic feedback as the movement platform 336 translates and/or pivots (as shown by arrows 358, 360, 362, 364, and 366) during training. Thus, in such dual-configuration embodiments, a user is presented with increased training options. Moreover, use of the movement platform 336 allows for a user's existing trainer to be retrofitted into a training system that provides the dynamic feedback and on-road type experience described herein by simply affixing their existing trainer to the movement platform 336.

What is claimed is:

1. A bicycle training system comprising:

a movement platform configured to rest on a support surface and support a bicycle in an upright manner with respect to the support surface, the movement platform comprising:

a support frame and including a base and at least one upstanding arm configured to supportably engage a portion of a frame of the bicycle;

a resistance assembly configured to operatively couple to a portion of a drivetrain of the bicycle and apply varying levels of resistance to the portion of the drivetrain; and a plurality of bushings isolating the base from the support surface, wherein the plurality of bushings are spherical thereby permitting the movement platform to move with respect to the support surface in response to forces applied to the bicycle frame during use of the bicycle training system.

2. The bicycle training system of claim 1, wherein each of the plurality of bushings includes a main body and a post extending from the main body.

3. The bicycle training system of claim 2, wherein the main body of each of the plurality of bushings is spherical when the respective bushing is in an equilibrium position.

4. The bicycle training system of claim 2, wherein the post of each of the plurality of bushings is cylindrical when the respective bushing is in an equilibrium position.

5. The bicycle training system of claim 1, wherein the resistance assembly includes a resistance mechanism operatively coupled to a roller.

6. The bicycle training system of claim 5, wherein the roller is configured to rotatably engage a rear wheel rotatably attached to the bicycle frame.

7. The bicycle training system of claim 5, wherein the resistance mechanism comprises an electric rotor and stator assembly.

8. The bicycle training system of claim 1, wherein the plurality of bushings are configured to permit the movement platform to translate in a horizontal plane parallel to the support surface and to pivot with respect to a vertical plane perpendicular to the horizontal plane.

9. The bicycle training system of claim 1, wherein each of the plurality of bushings is formed from a resilient polymer.

10. The bicycle training system of claim 1, wherein each of the plurality of bushings are elastically deformable between an equilibrium position and a shifted position, wherein each of the plurality of bushings is configured to elastically deform to the shifted position in response to a load being imparted on the bushing by forces applied to the bicycle frame, and wherein each of the plurality of bushings is configured to return to the equilibrium position when unloaded.

11. A method of training using a bicycle training system comprising:

resting a movement platform on a support surface, the movement platform comprising:

a support frame including a base and at least one upstanding arm;

a resistance assembly; and a plurality of spherical bushings isolating the base from the support surface;

supporting, with the movement platform, a bicycle in an upright manner with respect to the support surface including engaging a portion of a frame of the bicycle with the at least one upstanding arm;

operatively coupling a portion of a drivetrain of the bicycle to the resistance assembly;

applying various levels of resistance to the portion of the drivetrain using the resistance assembly; and moving the movement platform with respect to the support surface in response to forces applied to the bicycle during use of the bicycle training system through rolling movement of the plurality of bushings.

12. The method of claim 11, wherein each of the plurality of bushings includes a main body and a post extending from the main body.

13. The method of claim 12, wherein the main body of each of the plurality of bushings is spherical when the respective bushing is in an equilibrium position.

14. The method of claim 12, wherein the post of each of the plurality of bushings is cylindrical when the respective bushing is in an equilibrium position.

15. The method of claim 11, wherein the resistance assembly includes a resistance mechanism operatively coupled to a roller.

16. The method of claim 15 further comprising rotatably engaging, with the roller, a rear wheel rotatably attached to the bicycle frame.

17. The method of claim 15, wherein the resistance mechanism comprises an electric rotor and stator assembly.

18. The method of claim 11, wherein moving the movement platform with respect to the support surface comprises translating the movement platform in a horizontal plane parallel to the support surface and pivoting the movement platform with respect to a vertical plane perpendicular to the horizontal plane.

19. The method of claim 11, wherein each of the plurality of bushings is formed from a resilient polymer.

20. The method of claim 11 further comprising:

elastically deforming each of the plurality of bushings between an equilibrium position and a shifted position in response to a load being imparted on the bushing forces applied to the bicycle; and returning each of the plurality of bushings to the equilibrium position in response to unloading the bushing.

* * * * *